US006650864B2

(12) United States Patent
Miyamoto et al.

(10) Patent No.: US 6,650,864 B2
(45) Date of Patent: Nov. 18, 2003

(54) PRINTING SYSTEM

(75) Inventors: Atsushi Miyamoto, Hitachinaka (JP); Masahiro Mizuno, Hitachinaka (JP); Soushi Kikuchi, Hitachinaka (JP); Souichi Nakazawa, Hitachinaka (JP); Toru Kikuchi, Hitachinaka (JP); Satoshi Aita, Hitachinaka (JP); Shuho Yokokawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/000,306

(22) Filed: Dec. 4, 2001

(65) Prior Publication Data

US 2002/0081132 A1 Jun. 27, 2002

(30) Foreign Application Priority Data

Dec. 22, 2000 (JP) ..... 2000-389699

(51) Int. Cl.[7] ..... G03G 15/00
(52) U.S. Cl. ..... 399/384; 399/301
(58) Field of Search ..... 399/384, 401, 399/387, 301

(56) References Cited

U.S. PATENT DOCUMENTS 4,912,491 A * 3/1990 Hoshino et al. ..... 346/160
5,160,946 A * 11/1992 Hwang ..... 346/157

FOREIGN PATENT DOCUMENTS

| | | |
|---|---|---|
| EP | 3241117 | * 5/1884 |
| EP | 96/31809 | * 10/1996 |
| JP | 8-50429 | * 2/1996 |

* cited by examiner

*Primary Examiner*—Quana M. Grainger
(74) *Attorney, Agent, or Firm*—Antonelli, Terry, Stout & Kraus, LLP

(57) ABSTRACT

A printing system has a first printer apparatus for forming an image on a first plane of a web having no feed holes and a second printer apparatus provided at a post stage following the first printer apparatus for forming an image on a second plane of said web. The first printer apparatus (P1) is operable to form a position-alignment mark (Rm) at a predesignated position on each page of a web. This position-alignment mark is detected by mark detection means of the second printer apparatus (P2). Control means is provided for controlling the web transport speed so that both the generation timing of a web feed control signal (CPF-N signal) being generated with preset cyclic periods and the generation timing of a mark detection signal issued from the mark detection means through detection of the position-alignment mark are kept constant in phase.

14 Claims, 6 Drawing Sheets

PRINTING SYSTEM

BACKGROUND OF THE INVENTION

The present invention relates to a printing system for formation of images on both planes or surfaces of a web.

Print systems for forming images on both faces of webs, typically including elongate continuous strip-shaped paper sheets, are known. One of these systems is disclosed, for example, in Japanese Application Patent Laid-Open Publication No. Hei 8-50429, wherein a couple of separate printer devices are serially disposed for performing printing operations in such a way that printing is first performed on a first plane (top surface) of a web at one printer device forming a front stage; and then, after the web discharged from the front-stage printer device is turned over by an inversion device so that its top surface becomes a bottom or back surface, the web is supplied to the second printer device at a post stage, at which printing is carried out on a second plane (back surface) of the same web.

Prior known webs that are adaptable for use with printing systems of the type described above may generally include a so-called "continuous" paper sheet with feed holes along the opposite side edges thereof. Unfortunately, in cases where printing is carried out on such a continuous paper sheet with feed holes, there is a need after completion of the print operation to perform a paper-cutaway processing for cutting the feedhole-provided opposite edge portions away from the "body" of the printed paper sheet, which requires an increased length of time. The presently available approach to eliminating the timing-consuming and troublesome paper margin cutaway processing is to employ "special" printing systems that are capable of handling "feedhole-less" webs, i.e. webs without such feed holes, some of which systems are now becoming popular in the market.

Incidentally, in the printing systems described above, in case those systems are designed so that at least a printing device disposed at the front stage employs a printer apparatus of the type forming images by use of electrophotography, an additional heat-up process is inevitably required for fusion and photographic fixing of images (toner images) that have been transferred onto the web. Due to thermal action of this thermal fixation process, any web being fed into a printer apparatus of the post stage can experience unwanted thermal shrinkage so that its resultant size is less than that as measured in the original state thereof.

Upon occurrence of such thermal web-size reduction or shrinkage, the length of a page measured during top-surface printing becomes different from that during back-surface printing, resulting in production of awkward printed matter in which the top surface-side on-web image positions fail to be identical to those on the back surface thereof.

It should be noted that the web's thermal shrinkage amount is different depending upon a variety of parameters including, but not limited to, the thickness values and sizes of webs used or, alternatively, the attachment amount of toner particles for creation of on-web images; thus, any techniques for conveying webs for forward transportation with prediction of possible thermal shrinkage amounts are no longer employable.

SUMMARY OF THE INVENTION

It is a primary object of the present invention to provide a new and improved printing system that is capable of accurately printing images in such a way that an image on a first plane or surface is identical to that on a second plane or surface even in cases where a web being extruded from a first printer apparatus is shrunk or expanded due to environmental conditions.

The foregoing object is attainable by providing a specific printing system which has a first printer apparatus for forming an image on a first plane of a web having no feed holes and a second printer apparatus provided at a post stage of the first printer apparatus for forming an image on a second plane of said web, wherein at least the first printer apparatus has mark formation means for forming a position alignment mark at a predesignated position on each page of said web, and wherein at least the second printer apparatus has mark detection means for detecting said position alignment mark and control means for generating a web feed control signal once per preset period and for causing the generation timing of said web feed control signal to be identical in phase with the generation timing of a mark detection signal issued from said mark detection means through detection of said position alignment mark.

DESCRIPTION OF THE PREFERRED EMBODIMENTS

Preferred embodiments of the present invention will now be set forth with reference to the accompanying drawings.

Figure 1:
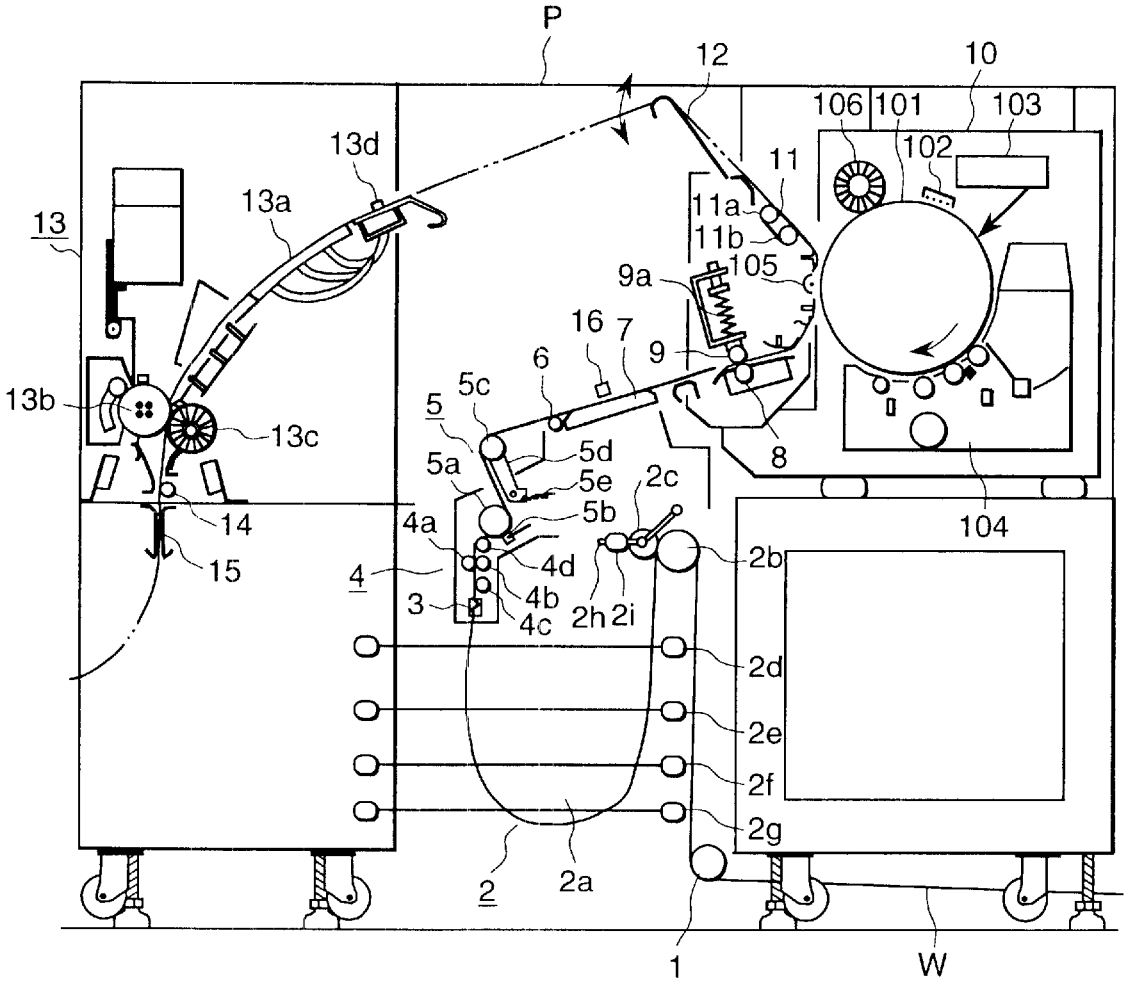
FIG. 1 is a diagram showing an overall arrangement of one unitary printer apparatus.

Referring first to FIG. 1, there is depicted an overall configuration of a printer apparatus of the type employing electrophotography, which apparatus is applicable to a printing system embodying the invention as disclosed and claimed herein. In FIG. 1, reference character "W" is used to designate a web. In the illustrative printer apparatus P, the web W may typically be a sheet of paper, although the web should not be limited thereto and may alternatively be made of other materials including, but not limited to, plastic films in some cases. The web W is supplied out of a paper feeder device (not shown) and is then conveyed so as to travel under the printer apparatus P and enter the printer apparatus P. After having been fed into the printer P, the web W is guided around a guide roller 1 disposed along the transport path so that it is conveyed toward a web buffer mechanism 2. Note here that the guide roller 1 per se has no drive source and is provided as a passively rotatable or non-driven roller, like a "follower", which is caused to rotate by contact with the web W being presently conveyed.

The web buffer mechanism 2 is arranged to include a storage unit 2*a* for temporary storage of the web W being conveyed, a pair of rollers 2*b*, 2*c* provided at an upstream portion of the web conveying/transport direction with respect to the storage unit 2*a*, and a plurality of sensors for monitoring any possible deflection/deformation amount (buffer amount) of the web W at the storage unit 2*a* (in this example, four pairs of optical sensors 2*d*, 2*e*, 2*f*, 2*g* are employed). Here, the above-stated roller 2*b* is provided as a driving roller which has its own drive source (not shown), whereas the roller 2*c* is provided as a driven or "follower" roller with no independent drive source. Additionally, the roller 2*c* is provided with an adjustment mechanism for adjusting the compressive contact forces against the roller 2*c*. In the illustrative embodiment, the adjustment mechanism is designed so that a weight 2*i* is slidably provided at a shaft 2*h* as projected from one end of the roller 2*c*, wherein this weight 2*i* is changed in position to thereby adjust the compressive contact force being applied from the roller 2*c* to roller 2*b* based on what is called the principle of a lever.

At the storage unit 2*a*, the buffer amount is ordinarily monitored to ensure that the bottom face of the loop of the web W is at the level of sensor 2*f*. If the bottom face of such web W arrives at the level of sensor 2*g*, as shown in the drawing, then control is performed causing the roller 2*b* to decrease in rotation speed to thereby permit the web W's bottom face at storage unit 2*a* to rise up to the level of sensor 2*f*. Alternatively, if the web W's bottom face reaches the level of sensor 2*e*, then control is performed to let roller 2*b* increase in rotation speed, thereby forcing the web W's bottom face at storage unit 2*a* to fall down at the level of sensor 2*f*. It should be noted that even where the above-noted rotation control of roller 2*b* is performed, it is impossible in some cases to return the web W to the level of sensor 2*f* due to abrasion of roller 2*b* or 2*c* and/or any possible contact force adjustment errors. In particular, the web's tensile force increases in intensity while the buffer amount decreases, which would result in physical destruction of the web being presently conveyed or transported. To avoid this risk, specific control is carried out to forcibly interrupt such web transportation in cases where the web W's bottom face has arrived at the level of sensor 2*d*.

Figure 2:
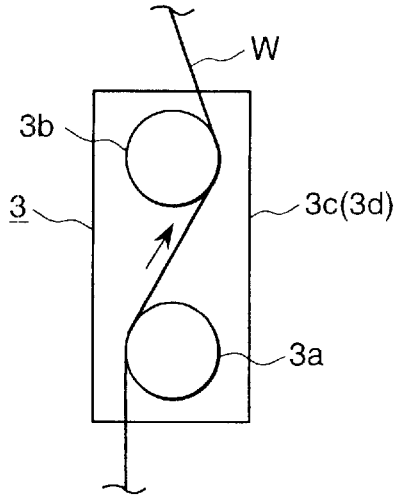
FIG. 2 is a diagram illustrating a guide member.
Figure 3:
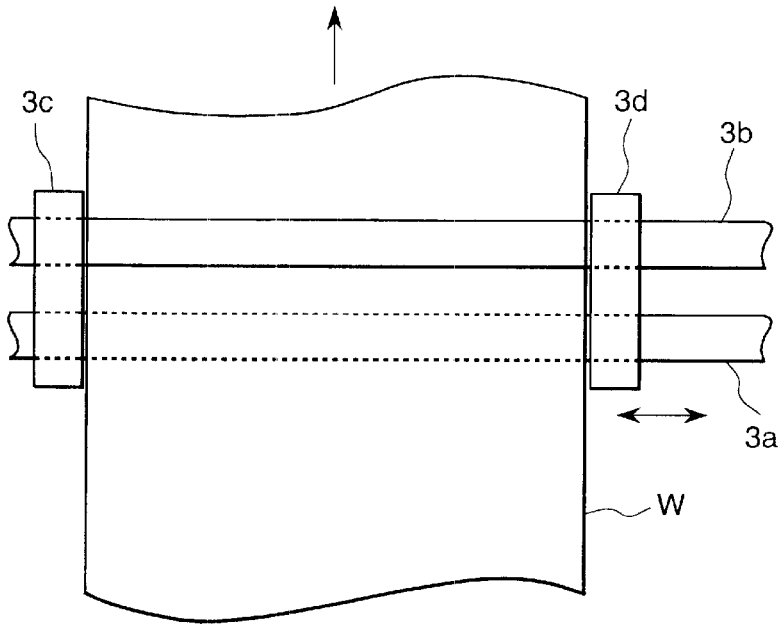
FIG. 3 is a diagram illustrating a guide member.

The storage unit 2*a* has a web carrying/transportation section, at which a guide member 3 is provided for regulation of edge positions of the web W being presently conveyed. The guide member 3 includes two separate shafts 3*a*, 3*b* that are arranged as shown in FIG. 2, for allowing the web W passing through such guide member 3 to be transported in such a way that it travels between the shaft 3*a* and shaft 3*b*. Also provided at the two shafts 3*a*, 3*b* are regulation members 3*c*, 3*d* for regulation of the position. in the width direction of the web W being transported (i.e. direction at right angles to the transport direction). Here, regarding the regulator members 3*c*, 3*d*, it will be desirable if either one of them or both is/are movably provided along the axial direction of the shafts 3*a*, 3*b*. This is because movably designing the regulator members 3*c*, 3*d* provides for enhanced handleability and applicability to a variety of kinds and forms of webs without being subjected to any limitations as to the sizes of the web W to be used in the printer apparatus. Additionally in this example, the regulator member 3*c* is provided so that it is immovably disposed at a prespecified position for enabling the regulator member 3*d* to move in accordance with the width of web W, as shown in FIG. 3. The guide member 3 is advantageous with respect to a web W that is loosened in the storage unit 2*a* in the way discussed above; thus, it is possible to readily correct or adjust the traveling position of the web W that is presently in contact with the guide member 3.

After having passed through the guide member 3, the web W is then conveyed into a contaminant removal mechanism 4. This contaminant removal mechanism 4 is generally structured from a pair of fixed shafts 4*a*, 4*b* and another pair of shafts 4*c*, 4*d* as provided at front and back positions of the shafts 4*a*, 4*b*, respectively. Here, the shaft 4*a* and shaft 4*b* are provided in such a manner that an extremely narrow preset gap (narrow gap) is defined therebetween. In some cases, an incoming web W would likely have contaminants attached thereto, such as paper particles and dusts; therefore, if a web with large bulk-like contaminants attached thereto is sent to a print/image-transfer module, then constituent parts or components of this module (e.g. photosensitive body or the like) can be physically damaged and scarred thereby. The above-noted narrow gap is provided for preclusion of unwanted "invasion" of such contaminants. Accordingly, in cases where contaminants are rigidly attached to web surfaces, for example, so that it is impossible to remove or peel off these contaminants from the web surfaces even after penetration into the narrow gap, the web W can be broken and cut away at such position, thereby preventing occurrence of any damage and scars or the like at the components making up the print/image-transfer module. With regard to the narrow gap, it must be noted that although this gap is set at about 0.5 mm in this example, its size should not exclusively be limited thereto and may be set on a case-by-case basis to have appropriate dimensions in a way pursuant to the shape and arrangement of a web-carrying/transport path being used. Also note that the shaft 4*c* and shaft 4*d* provided in front of and behind the shafts 4*a*, 4*b* are designed to function as guide members for guiding the web W toward the narrow gap.

After having passed through the contaminant removal mechanism 4, the web W is next guided to enter a tension addition mechanism 5. This tension addition mechanism 5 consists essentially of a drum 5*a* without any drive source, a roller 5*b* provided in contact with this drum 5*a*, and a drum movably supported over the web transport path. Here, the drum 5*a* is replaceable with a stationary drum or alternatively with a driven or "follower" drum to be rotated upon application of a drive force occurring due to contact with the web W being presently conveyed. The roller 5*b* in tight contact under pressure or "compressive contact" with the drum 5*a* is provided as a follower roller-in the illustrative example, a specific roller arrangement is employed wherein this roller is subdivided into a plurality of parts in the width direction of web W. Additionally, the drum 5*c* is fixed at the free distal end of an arm 5*d* that is supported rotatably, so that the drum 5*c* is constantly activated by a spring 5*e* to come into contact with a surface of web W. Providing the above-stated tension addition mechanism 5 ensures that the tensile force of web W is kept constant in intensity.

After having passed through the tension addition mechanism 5, the web W is driven by transport rollers 8, 9 to reach a print/image-transfer unit 10 through a guide shaft 6 and a guide plate 7 associated therewith.

The print/image-transfer unit 10 is arranged to employ a print/image-transfer device of the type using electrophotographic recording, by way of example. Upon startup of rotation of a photosensitive drum 101, which is exemplary indicated as an image carrier body, a high potential voltage is applied to a corona electrostatic charger 102 causing the photosensitive drum 101 to be electrically changed uniformly on the surface thereof. Rays of light from a light source 103, made up of more than one semiconductor laser or light-emitting diode or equivalents thereto, fall onto the photosensitive drum 101 to thereby effectuate image exposure thereon, thus forming an electrostatic latent image on photosensitive drum 101. When a photosensitive drum region carrying this electrostatic latent image thereon reaches a certain position opposing an exposure device 104, developing powder is supplied to the latent image, resulting in formation of a toner image on the photosensitive drum 101. The toner image as formed on photosensitive drum 101 is then sucked onto the web W through action of a transfer device 105, which operates to add an electrical charge of the opposite polarity to the toner image onto the back face of web W. The region that has passed through the transfer position of photosensitive drum 101 is then cleaned up by a cleaner device 106 in preparation for the next print operation.

The web W with the toner image transferred thereonto from the print/image-transfer unit 10, in the way stated above, will then be conveyed and transported by a conveyer belt 11 toward the post stage. Here, regarding the transport rollers 8, 9, these are arranged so that the transport roller 8 is provided as a driving roller with its own drive source, whereas the other transport roller 9 is provided as a driven or "follower" roller that is biased by elastic force of a spring 9*a* into contact with the transport roller 8 with the web W interposed therebetween. Additionally, the conveyer belt 11 is held in such a manner that it is wound around both the drive roller 11*a* and follower roller 11*b* and is arranged to include a suction device (not shown), thereby offering transportability, while allowing the back face of web W to be sucked onto the conveyer belt 11.

The web W that has been conveyed by the conveyer belt 11 is transported toward a photographic fixing device 13 along a buffer plate 12. The web W that has reached the fixation device 13 is then subject to a preheating process at a preheater 13*a* and, thereafter, is clamp-conveyed while being heated and pressed by a nip section formed of a pair of fixation rollers, which consist of a heatup roller 13*b* and pressurization roller 13*c*, causing the toner image to be welded and fixed to the web W.

The web W that has been delivered by the heatup roller 13b and pressure roller 13*c* travels through a delivery roller 14 and also is ordinarily folded alternately by swinging pendulum operations of a swingable fin 15 so that this web is stacked into an accordion-like multilayer structure within the printer apparatus P. In contrast thereto, in case another printer apparatus is disposed at the post stage of such printer apparatus P for constitution of the intended printing system, the web W that has been delivered by the heatup roller 13*b* and pressure roller 13*c* will be discharged out of the printer apparatus P via the delivery roller 14 and then transported toward the "second" printer apparatus (not shown), as indicated by the broken line in FIG. 1.

It should be noted in FIG. 1 that the buffer plate 12 absorbs any possible looseness or tension occurring at the web W upon occurrence of a web transport speed difference between the conveyer belt 11 and fixation rollers 13*b*–13*c* . In this regard, it provides an associative control system in such a way as to ensure application of a constant tensile force on the web W by causing the heatup roller 13 to rotate at high speeds if the buffer plate 12 is slanted to positions higher than a preset neutral position of the buffer plate 12, to thereby cause the buffer plate 12 to drop down at the neutral position, or, alternatively, by forcing the heatup roller 13*b* to rotate at low speeds if the buffer plate 12 is slanted to positions lower than the neutral position, to thereby cause the buffer plate 12 to rise up to the neutral position.

Figure 4:
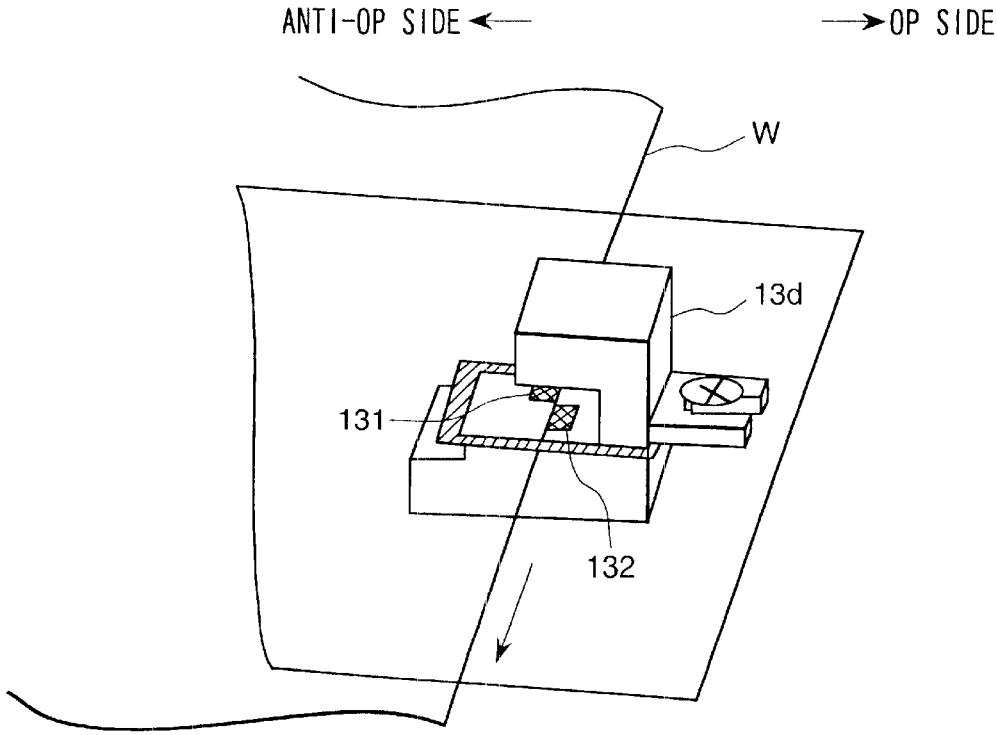
FIG. 4 is a diagrammatic perspective view of a serpentine detection sensor.

In addition, reference character "13*d*" is used to indicate a sensor for detection of serpentine or "snaking" movement of the web W. In the printer apparatus P of the illustrative embodiment, there is employed a specific kind of web without any feed holes at the opposite edge portions in the web width direction. The sensor 13*d* is thus designed to detect a present serpentine amount on the basis of the edge positions of the web W, as shown in FIG. 4. For instance, the sensor 13*d* comprises independent light shield amount detecting sections 131, 132 on an apparatus front side (referred to as the "OP side" hereinafter) and an apparatus rear side (referred to hereafter as the "anti-OP side") with a web edge serving as a boundary between them. These light-shield detectors 131–132 are constructed such that an LED and photodiode (operable to output a linear voltage in accordance with the amount of light rays received) are disposed to oppose each other for detecting a present position of the web W existing therebetween from the resultant light shield amount. And, an arrangement is employed for changing, in response to an output from the sensor 13*d*, the compressive contact forces on one-edge side and its opposite side of the pressure roller 13*c* with respect to the heatup roller 13*b*, to thereby correct a present travel location of the web W that is in serpentine states.

Additionally, reference numeral 16 is used to denote a mark detection means (mark sensor) for detecting position alignment marks formed on the web W. This mark sensor 16 is inevitably required especially for use in a printer apparatus located at the post stage, wherein the mark sensor 16 is operable to detect a position alignment mark that has been printed at a page head edge simultaneously upon execution of image printing on a surface of the web W at the printer apparatus of the front state, and then generate and issue a signal for control to guarantee that an image being printed on the back face of web W at the second printer apparatus and an image that has been printed on the top face of web W at the first printer apparatus are accurately performed without any positional deviation (in a way that will be described in detail later in the description).

Figure 5:
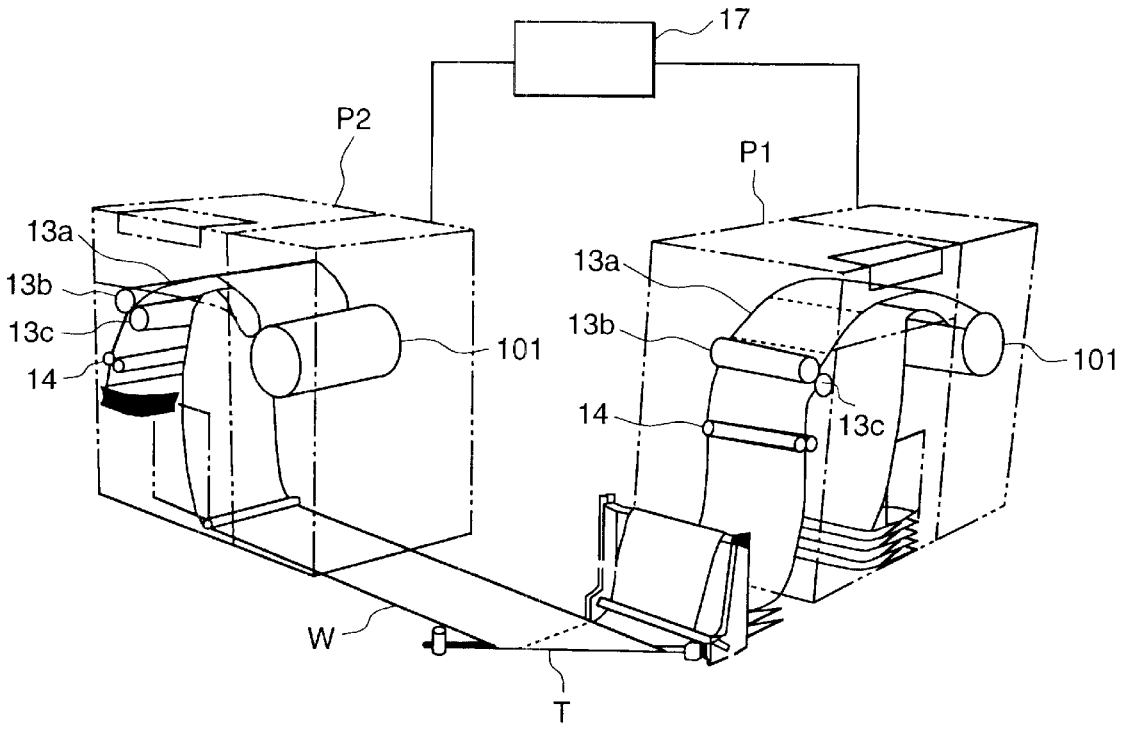
FIG. 5 is a diagrammatic perspective view showing an overall arrangement of a printing system.

The arrangement stated above is merely for explanation of the arrangement of a single printer apparatus-in the case of using as a printing system, another printer apparatus P is prepared to be installed as shown in FIG. 5, by way of example. With such installation in this way, the adverse and reverse-side surfaces-say, "head" and "tail" faces-of the web that has been delivered from the top printer apparatus P1 are interchanged or "inverted" by an inversion device T; thereafter, the web is conveyed toward the following, next-stage printer apparatus P2 for formation of an image on a second surface of the web W also.

An explanation will next be given of the relation of an output signal of the mark sensor versus web transport control.

Figure 6:
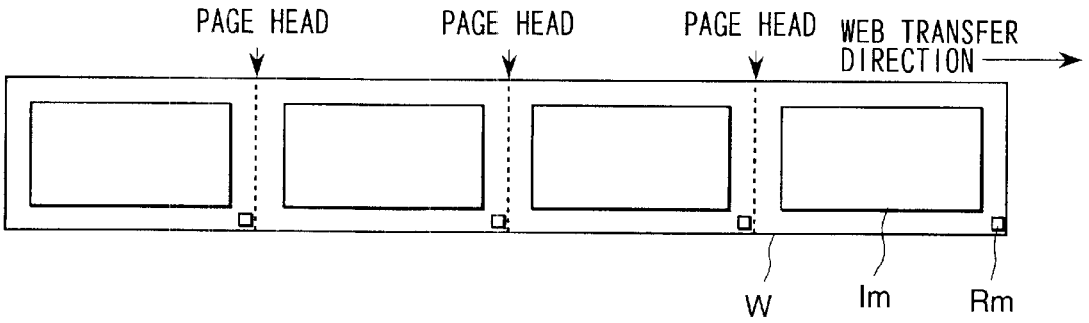
FIG. 6 is a diagram showing a pictorial representation of a positional relationship of position alignment marks.

As shown in FIG. 6, an image Im based on print data is printed on the web W at the first printer apparatus Pl, while at the same time a position alignment mark (toner mark) Rm is printed at the top edge of each page; and then, it is discharged from the printer apparatus P1. Note here that the position alignment mark formation means may be separately provided in a way independent of the means for forming the image Im or, alternatively, it may be formed on the photosensitive drum together with the image Im. In this example, the latter arrangement is employed to form the position alignment marks required.

The web W that was discharged from the printer apparatus P is conveyed to the second printer apparatus P2 with the web's head and tail surfaces having been reversed relative to each other at the inversion device T. With such web W's head/tail face reversing process as executed by the inversion device T, a specific web face (first plane) on the side with the toner mark Rm thereon becomes to oppose the detection plane of the mark sensor 16, whereas the remaining web face (second plane) in a white blank state opposes the surface of the photosensitive drum 101.

The page top or "head" as virtually set on the photosensitive drum 101 is recognizable at the time of issuance of a web feed control signal (referred to as "CPF-N signal" hereinafter) coming from a controller 17. Additionally, since the photosensitive drum 101 is controlled so as to exhibit constant-speed rotation at a preset process speed, the page head on the photosensitive drum 101 can be expected to arrive at a transfer point TP at a time when a single cyclic period of the CPF-N signal has elapsed-that is, on a per-CPF length basis. Accordingly, it becomes possible, by specifically controlling the web transport speed in such a way that the issuance timing of the CPF-N signal from the controller 17 is identical in phase to the timing at which the mark sensor 16 detects the toner mark Rm, to make the page head on photosensitive drum 101 identical to the page head of web W at the transfer point TP, while increasing or maximizing the accuracy thereof.

Figure 7:
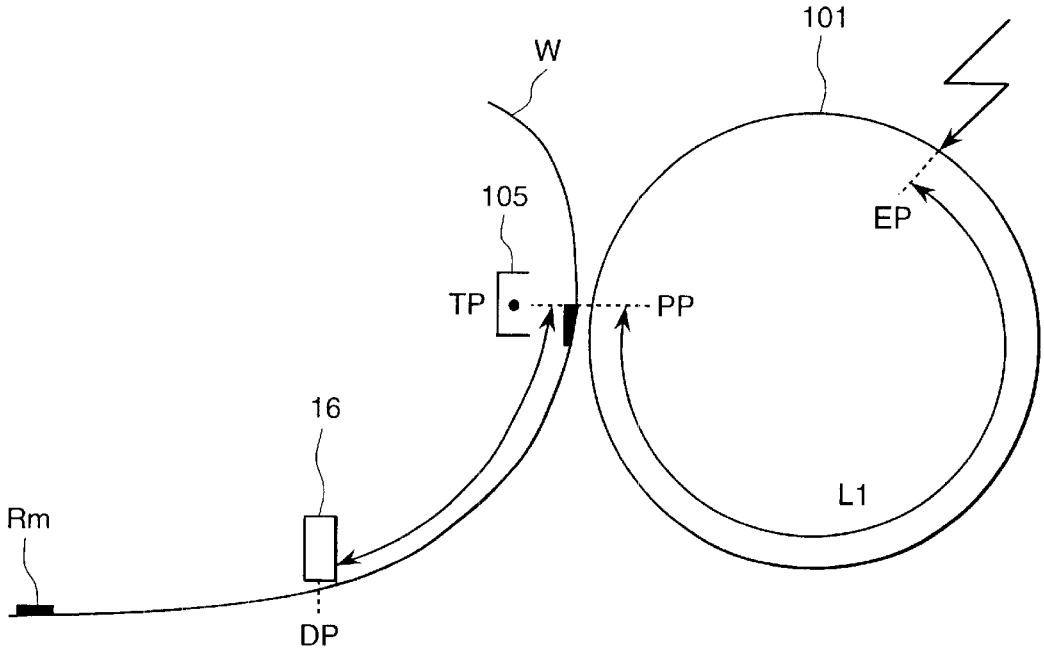
FIG. 7 is a diagram illustrating position alignment control.

With the illustrative embodiment, a distance on the surface of photosensitive drum spanning from the transfer point TP due to a transfer device 105 up to an exposure point EP is represented by "L1", whereas a distance along the web transport path from the transfer point TP to a detection point DP where the mark sensor 16 is located is given as "L2", as shown in FIG. 7. Here, the "control timing" is defined as a toner detection timing in the state that the web transportation is being done, while retaining the relation that a page head PP as virtually set on the photosensitive drum 101 and the toner mark Rm indicative of the web W's page head are identical to each other at the transfer point TP.

Incidentally, in regard to the back-face printing of the first page upon startup of the printing operation, the page head position on a top surface and the page head position of a back surface are ordinarily identical to each other due to the fact that an operator permits any intended printing operation to get started after having loaded a chosen web W into the printer apparatus P2 at a prespecified position thereof.

Figure 8:
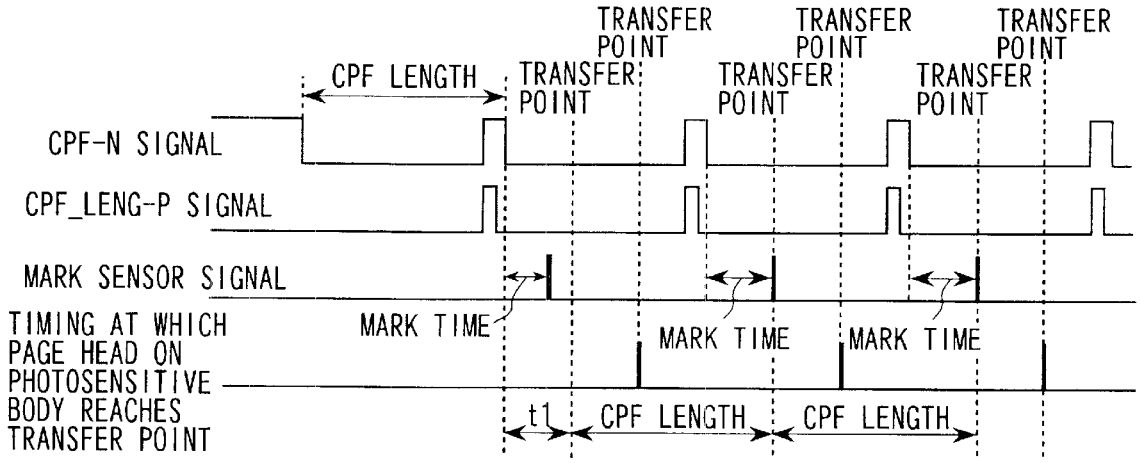
FIG. 8 is a timing chart showing an example of the operation of the present invention.

Arriving at the timing at which formation of print data of a first page on the photosensitive drum 101 is completed, the printer apparatus is expected to receive a first incoming CPF $CPF_{13}$ LEG-P signal from the controller 17 as shown in FIG. 8. Upon receiving the $CPF_{13}$LEG-P signal, arithmetic processing or computation for calculation of the above-noted control timing is executed. Here, such control-timing calculation is performed, for example, based on the principal concept which follows. To be brief, in order to force the page head on a second page, as virtually set on the photosensitive drum 101, and a toner mark on a second page of the web W to be identical with each other at the transfer point TP, it should be required that the toner mark 19 be detected exactly when the page head of the second page on the photosensitive drum 101 comes at the position of L2 from the transfer point TP. As a consequence, letting the process velocity of the printer apparatus be "vp," a time taken from receipt of a second incoming CPF-N signal to the above-noted control timing, t1, may be given as:

$$t1=(L1-L2)/vp \qquad \text{Eq. (1)}$$

Additionally, in view of the fact that data indicative of the page head on the photosensitive drum 101 must reach the transfer point TP on a per-CPF length basis, any following control timings will be on the per-CPF length basis. From a detection deviation time of toner mark Rm relative to this control timing, an exact degree of deviation of the page head being printed on the back face with respect to the page head on the top surface will be recognized; and so, if the toner mark Rm detection timing is delayed relative to said control timing, then the web transport speed is allowed to increase. On the other hand, if the toner mark Rm detection timing is advanced relative to the control timing, then the web transport speed is allowed to decrease. In brief, what is done here is to control the web transport speed so that the timing for detection of a toner mark Rm is identical to the control timing.

Further, the controller 17 may be so modified as to comprise, in addition to the above control, a memory (not shown) for use as a means for storing therein a time period (mark time) taken from receipt of a CPF-N signal up to detection of a toner mark Rm once at a time whenever each toner mark Rm is actually detected. And, upon detecting each toner mark Rm, arithmetic computation means (not shown) is rendered operative to compute any appreciable difference Δt between "old" data (mark time t0) that has been stored in said memory when the prior toner mark detection was performed and "new" data (mark time t2) stored in said memory during detection of a presently found toner mark, for example, based on the equation presented below:

$$\Delta t=t2-t0 \qquad \text{Eq. (2)}$$

And, the web transport speed at such a time point is allowed to increase or decrease by a degree corresponding to a ratio of Δt to the CPF length. Letting the web transport speed be represented by "v" and the speed to be adjusted be given as "Δv," the value of Δv is determinable by the following equation:

$$\Delta v=(\Delta t/CPF\ \text{Length})\times v \qquad \text{Eq. (3)}$$

As a result of adding Δv to the web transport speed v at the detection time point of interest, the timing for detection of the toner mark Rm becomes identical to the control timing.

With such an arrangement, even where a web W with unwanted thermal shrinkage due to the influence of fixation heat or other factors is supplied to the post-stage printer apparatus during top-surface printing, it becomes possible for the on-the-backface printing position to be identical to the print position on the top surface, which in turn makes it possible to increase the printing reliability even with respect to those webs having no feed holes.

In addition, although in the above-discussed embodiment one specific exemplary case was described for controlling the web transport speed, while letting the timing indicative of a page head on the photosensitive drum to be identical in phase to the timing for detection of an on-web printed toner mark, simply controlling the photosensitive drum to rotate at a constant speed to thereby control only the web transport speed would result in occurrence of a speed difference between the web being presently delivered and the photosensitive drum, which in turn causes a practical problem in that images to be transferred onto the web can experience turbulence. Additionally, an increased amount of friction can take place between the photosensitive drum and the web, which might cause a problem in that the life of the photosensitive drum is shortened.

Figure 9:
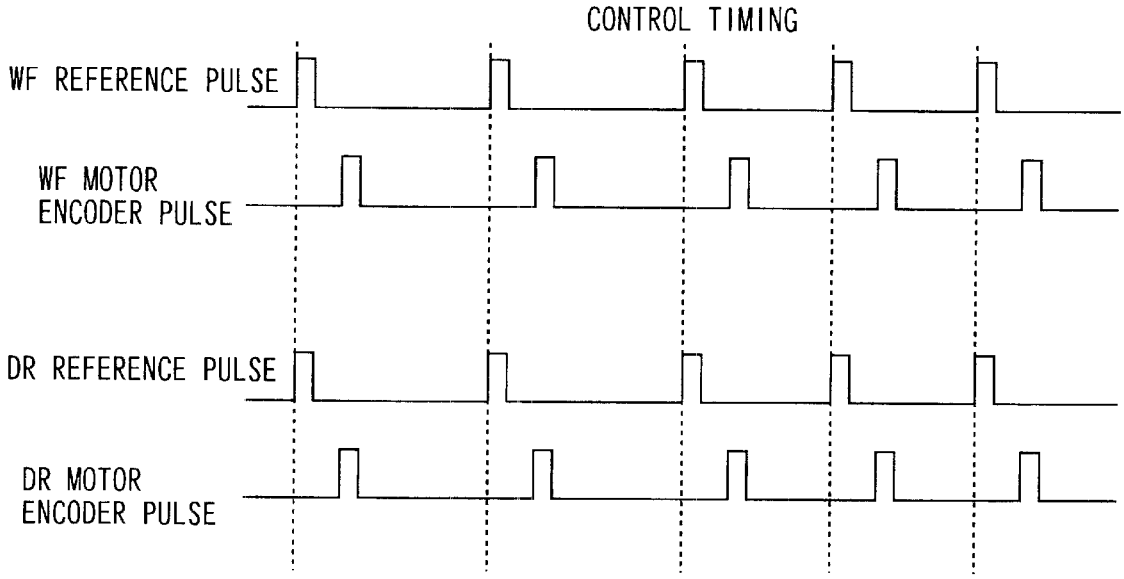
FIG. 9 is a timing chart showing synchronous control of web transfer and the photosensitive drum.

In view of the above, as a more preferable embodiment of the present invention, it becomes effective to synchronously control the web transport speed and the rotation speed of the photosensitive drum. In this case, as shown for example in FIG. 9, rotation speed control of a web transport motor for driving the web conveying/transport system is achievable by causing an encoder pulse (to be referred to as "WF encoder pulse" hereinafter) output from such web transport motor to keep track of or "follow up" a reference pulse (referred to hereafter as "WF reference pulse"). Thus, changing the WF reference pulse in frequency permits the web transport speed to vary accordingly.

Similarly the rotation speed of a photosensitive body drive motor for driving the photosensitive drum is controllable by letting an encoder pulse ("DR encoder pulse") output from the photosensitive drum drive motor keep track of a reference pulse (DR reference pulse). Thus, changing the DR reference pulse in frequency allows the photosensitive drum to likewise vary in rotation speed.

And, modifying the frequency of the DR reference pulse at the timing for acceleration or deceleration of the web transport speed in a way synchronous with the WF reference pulse makes it possible to change both of the web transport speed and the photosensitive drum's rotation speed at the same time.

Figure 10:
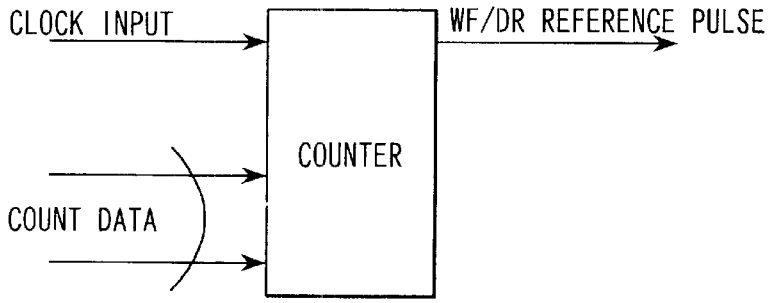
FIG. 10 is a block diagram of one example of a synchronous control circuit.

Turning to FIG. 10, there is shown one example of the circuitry for modification, while letting the WF reference pulse and DR reference pulse to be synchronized with each other. With this circuitry, it is possible by changing count data to change the WF reference pulse and DR reference pulse at substantially the same timing. Additionally, since a single count data item is used to create the WF/DR reference pulses, it becomes possible to change the speed or velocity by the same rate.

Figure 11:
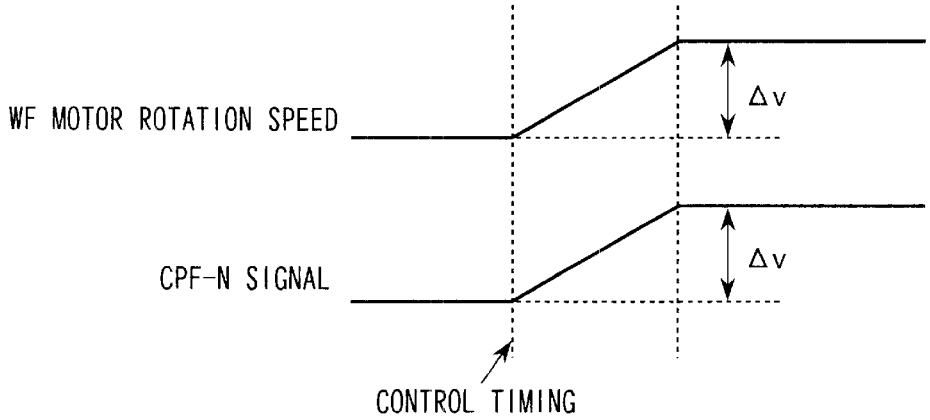
FIG. 11 is a diagram illustrating synchronous control of web transfer and the photosensitive drum.

With use of the above-stated circuitry, it is possible to simultaneously change both the rotation speed of a web carrying motor (WF motor) and that of a photosensitive drum drive motor (DR motor) by velocity $\Delta v$ at a certain timing, as shown in FIG. 11.

Furthermore, in printing systems of this type, post-processing devices (such as paper cutting devices, staplers, punchers, book binding machines and others) are sometimes installed at the post stage of the second printer apparatus. If this is the case, in order to automatically identify exactly what kind of post-processing is to be applied to the webs being printed, identification (ID) symbols, ID data bits or ID codes or the like are printed on such webs in some cases, wherein these ID symbols and the like are ordinarily printed in regions outside of an image region.

Accordingly, in this case, there is established a condition in which position alignment marks and ID symbols or the like are copresent together in marginal regions outside of the image region, which can cause the mark sensor to erroneously detect an ID symbol or the like as one of the position alignment marks, resulting in an inability to achieve any accurate coincidence or matching of print positions.

To avoid such a risk, according to a further preferable embodiment of the present invention, the toner mark detection to be handled by the mark sensor is made effective only during a preset time period, thereby regulating the resultant detection time period.

Figure 12:
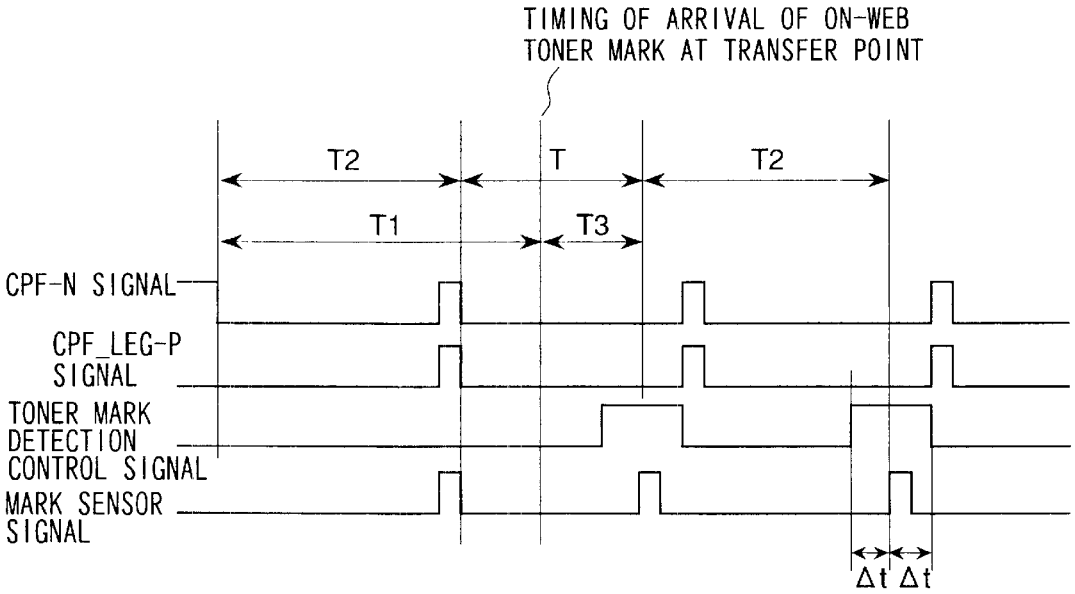
FIG. 12 is a timing chart showing an example of the operation of another embodiment of the present invention.

One example is shown in FIG. 12, wherein toner mark detectable time periods are set in time intervals $\Delta t$ before and after of the timing for elapse of a time T following generation of a first $CPF_{13}$ LEG-P signal, while letting it be electrically "masked" during the remaining time periods. Note here that predefinition as regions for inhibition of printing of ID symbols or the like is done to ensure that any ID symbols or the like are disabled within the time periods $\Delta t$ before and after the toner mark; thus, it is no longer possible that only toner marks are recorded in such regions.

As has been described above, according to the present invention, it is possible to provide an improved printing system that is capable of accurately printing images on a second plane or surface of a web in such a way that an image on a first plane or surface thereof is identical to that on the second plane, even in cases where a web being discharged from a first printer apparatus is presently shrunk or expanded due to environmental conditions.

What is claimed is:

1. A printing system having a first printer apparatus for forming an image on a first plane of a web having no feed holes and a second printer apparatus provided at a post stage of the first printer apparatus for forming an image on a second plane of said web, characterized in that at least the first printer apparatus has mark formation means for forming a position alignment mark at a predesignated position on each page of said web, and at least the second printer apparatus has mark detection means for detecting said position alignment mark and control means for generating a web feed control signal once per preset period and for causing the generation timing of said web feed control signal to be identical in phase with the generation timing of a mark detection signal as issued from said mark detection means through detection of said position alignment mark.

2. The printing system as recited in claim 1, characterized in that said control means includes means for controlling the transport speed of said web.

3. The printing system as recited in claim 1, characterized in that at least the second printer apparatus has an image carrying body for temporarily holding said image and that said control means includes means for controlling synchronization of the transport speed of said web and a travel speed of said image carrying body.

4. The printing system as recited in claim 1, characterized in that said control means includes storage means for storing therein the length of a time as taken from issuance of said web feed control signal to detection of said position alignment mark by said mark detection means whenever each position alignment mark is detected, arithmetic processing means for arithmetically determining a difference between new data being stored in said storage means and old data as has been stored before its one preceding page, and means for controlling the transport speed of said web based on an output of said arithmetic processing means.

5. The printing system as recited in claim 1, characterized in that at least the second printer apparatus has an image carrying body for temporally holding said image and that said control means includes storage means for storing therein the length of a time as taken from issuance of said web feed control signal to detection of said position alignment mark by said mark detection means whenever each position alignment mark is detected, arithmetic processing means for arithmetically determining a difference between new data being stored in said storage means and old data as has been stored before its one preceding page, and means for controlling the transport speed of said web based on an output of said arithmetic processing means.

6. The printing system as recited in claim 1, characterized by comprising detection period regulation means for enabling detection of said position alignment mark by said mark detection means within a preset time period only.

7. The printing system as recited in claim 1, characterized in that at least the first printer apparatus comprises photographic fixing means for adding at least heat to the web presently holding said image to thereby photographically fix said image on said web.

8. The printing system as recited in claim 1, characterized in that said first printer apparatus includes a first imaging apparatus for forming the image on the first plane of the web, and said second printer apparatus includes a second imaging apparatus which is separate from the first imaging apparatus of said first printer apparatus for forming the image on the second plane of said web.

9. A printing system comprising:

a first printer apparatus for forming an image on a first plane of a web having no feed holes; and a second printer apparatus provided at a post stage of the first printer apparatus for forming an image on a second plane of said web;

wherein at least the first printer apparatus has mark formation means for forming a position alignment mark at a predesignated position on each page of said web;

wherein at least the second printer apparatus has mark detection means for detecting said position alignment mark and control means for generating a web feed control signal once per preset period and for causing the generation timing of said web feed control signal to be identical in phase with the generation timing of a mark detection signal as issued from said mark detection means through detection of said position alignment mark;

wherein said first printer apparatus includes a first imaging apparatus for forming the image on the first plane of said web, and said second printer apparatus includes a second imaging apparatus which is separate from the first imaging apparatus of said first printer apparatus for forming the image on the second plane of said web; and wherein at least the first printer apparatus includes photographic fixing means for adding at least heat to said web presently holding said image to thereby photographically fix said image on said web.

10. The printing system as recited in claim 9, wherein said control means includes means for controlling the transport speed of said web.

11. The printing system as recited in claim 9, wherein at least the second printer apparatus has an image carrying body for temporarily holding said image and that said control means includes means for controlling synchronization of the transport speed of said web and a travel speed of said image carrying body.

12. The printing system as recited in claim 9, wherein said control means includes storage means for storing therein the length of a time as taken from issuance of said web feed control signal to detection of said position alignment mark by said mark detection means whenever each position alignment mark is detected, arithmetic processing means for arithmetically determining a difference between new data being stored in said storage means and old data as has been stored before its one preceding page, and means for controlling the transport speed of said web based on an output of said arithmetic processing means.

13. The printing system as recited in claim 9, wherein at least the second printer apparatus has an image carrying body for temporally holding said image and that said control means includes storage means for storing therein the length of a time as taken from issuance of said web feed control signal to detection of said position alignment mark by said mark detection means whenever each position alignment mark is detected, arithmetic processing means for arithmetically determining a difference between new data being stored in said storage means and old data as has been stored before its one preceding page, and means for controlling the transport speed of said web based on an output of said arithmetic processing means.

14. The printing system as recited in claim 9, further comprising detection period regulation means for enabling detection of said position alignment mark by said mark detection means within a preset time period only.

* * * * *